United States Patent [19]

Urfer et al.

[11] 4,170,678

[45] Oct. 9, 1979

[54] MULTIPLE USE ARTICLE FOR CONDITIONING FABRICS IN A CLOTHES DRYER

[75] Inventors: Allen D. Urfer, Naperville; Frank H. Stevens, Saint Charles, both of Ill.

[73] Assignee: A. E. Staley Manufacturing Company, Decatur, Ill.

[21] Appl. No.: 938,179

[22] Filed: Aug. 30, 1978

[51] Int. Cl.[2] ..... G01M 1/00

[52] U.S. Cl. ..... 428/124; 252/8.75; 252/8.6; 428/411

[58] Field of Search ..... 428/411, 124; 252/8.75, 252/8.6, 90, 93

[56] References Cited

U.S. PATENT DOCUMENTS

| | | | |
|---|---|---|---|
| 3,686,025 | 8/1972 | Morton | 252/8.6 |
| 3,743,534 | 7/1973 | Zamora | 428/411 |
| 4,004,685 | 1/1977 | Mizuno et al. | 252/8.6 |
| 4,049,858 | 9/1977 | Murphy | 252/8.7 |

*Primary Examiner*—George F. Lesmes
*Assistant Examiner*—E. Rollins Buffalow
*Attorney, Agent, or Firm*—Howard J. Barnett; Charles J. Meyerson

[57] ABSTRACT

A multiple use article for conditioning of fabrics in a laundry dryer comprising an initially multiple-layer flexible substrate carrying a conditioning agent transferable to fabrics when tumbled therewith in a clothes dryer. The dryer operator modifies the shape of the multiple-layer flexible substrate between successive uses to expose additional fabric-conditioning agent for transfer to additional fabrics subsequently loaded in the clothes dryer.

9 Claims, 5 Drawing Figures

MULTIPLE USE ARTICLE FOR CONDITIONING FABRICS IN A CLOTHES DRYER

BACKGROUND OF THE INVENTION

1. Field of the Invention

Fabric-conditioning has taken on increasing importance with increased use of synthetic fibers in articles of clothing. Such synthetic fabrics are initially treated with conditioning agents by the manufacturers, but washing or dry cleaning the fabrics tends to remove the conditioning agents.

Various methods have been proposed to apply conditioning agents to fabrics to improve their various properties. Such fabric conditioners include softeners, antistats, lubricants, bacteriostats, mildew-proofers, mothproofers and the like. The methods of application include treatment of the fabrics by padding, dipping, spraying and rinsing with liquid solutions of the conditioning agents.

After several washings, clothes made from synthetic fibers tend to have a net surface charge and exhibit annoying tendencies to attract lint and to cling to the wearer. Certain cationic softeners are used on such fibers to provide a softer "hand" to the fabric to neutralize the excess charge, and to thereby eliminate static cling and lint pick-up by clothes made from synthetic fibers.

Until recently, the most typical domestic method of applying fabric softeners to clothing has been by adding the softening agent to the final rinse in the automatic clothes washing machine. This method is inconvenient because the operator must be at the washing machine at the proper time, unless the machine is equipped with an automatic dispenser for the rinse cycle.

The inconvenience of adding fabric softeners at the rinse cycle has generated interest in fabric-conditioning products which may be added to the clothes dryer to tumble with, and condition the drying clothes. Applying fabric softeners in the dryer offers an important convenience because the softeners can be added at the time the clothes dryer is loaded. In addition, the softeners can be applied directly from a solid substrate in solid form, as contrasted with the dilute solutions used in the final rinse cycle of the clothes washing process.

2. Prior Art

Dryer-administered fabric softeners are disclosed in U.S. Pat. Nos. 3,442,692; 3,686,025; 3,895,128; 3,944,694; 3,967,008 and others. Commercially available fabric softener articles include one which comprises a slitted, non-woven substrate carrying a fabric softener, and a second type which is a polyurethane sponge carrying a fabric softener. A third type, which has been marketed to a somewhat lesser extent, comprises a fabric bag containing powdered fabric softeners. The bag containing the softeners is taped, or otherwise secured, to a leading surface on a dryer drum vane. The softener is said to release from the bag and transfer to clothes tumbled in the dryer over a number of dryer loads.

None of the above patents or the commercially available articles include a multiple-layer substrate which can be modified by the dryer operator to expose additional fabric softener for transfer to the tumbling clothes. U.S. Pat. No. 3,944,694 discloses a non-woven substrate provided with slit openings to allow air to pass through the substrate even when it becomes positioned over the dryer vent, but it does not describe multiple-layered substrates for controlled release of fabric softener.

The non-woven substrates described in U.S. Pat. Nos. 3,686,025 and 3,944,694 employ approximately 30% by weight adhesive, based on the total weight of the non-woven substrate, to bind the substrate together. In contrast, the adhesive in the substrate of the present invention comprises about 50% of the total weight of the substrate. Because of the method of manufacture, the substrate of the subject invention tends to have a greater concentration of adhesive on one surface.

SUMMARY OF THE INVENTION

This invention is directed to a fabric-conditioning article which initially comprises a plurality of layers of flexible substrate, loosely bonded together so as to initially expose only a portion of the total surface of substrate to a first dryer load of clothes to be softened. After unloading the dryer, the layered substrate is modified by the operator to expose previously unexposed surfaces of the fabric softener article substrate to contact with a new load of clothes being tumbled in the clothes dryer.

The present invention is directed to an improved, multiple-use, controlled-release fabric conditioner article for use in a clothes dryer. Initially, the flexible substrate carrying the fabric-conditioning materials comprises two single sheets fastened together to expose only a part of the substrate surface to the clothes being tumbled. The overall dimensions of the fabric-conditioning article, its weight and stiffness prevent it from becoming lodged on the exhaust vent of the dryer to block airflow. The exposed surface of the substrate provides enough fabric conditioner transfer to the clothing during the tumbling action of the first load drying cycle to effectively condition the clothing in the dryer.

After the first load of clothing has been removed from the clothes dryer, the fabric softener article is peeled apart at the loosely-bonded end, thereby exposing additional fabric conditioner-impregnated surface, and thereby increasing the overall length of the sheet. The added length causes the fabric softener article to readily catch on the tumbling clothes to thereby prevent blocking of the dryer exhaust vent. The presently preferred dimensions for the fabric softener article are about 5½" by 9" when folded for first use, and about 5½" by 18" when unfolded for second use.

DETAILED DESCRIPTION OF THE INVENTION

Figure 3:
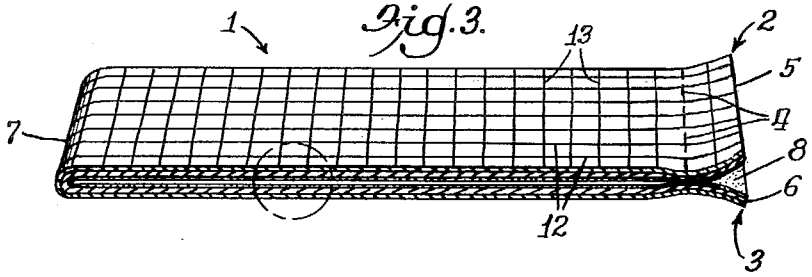
FIG. 3 is a longitudinal-sectional, diagrammatic view on line 3—3 of FIG. 1.

As shown in the drawings, a fabric conditioner article 1 includes a first-folded portion 2 and a second-folded portion 3, secured together at a seam 4 near the end edges 5 and 6, and parallel thereto. The end 7 is merely a fold of the folded portions 2 and 3, and when the seam 4 is broken, the article unfolds to double its length. Adhesive 8 bonds the article 1 together, and is primarily towards the outer surface 9 of folded portions 2 and 3, due to the method of manufacture of the article. Fabric conditioner 10 is coated over the adhesive 8, and the fabric conditioner 9 is also coated on the inner surface 11 of the folded portions 2 and 3.

Longitudinal fiber ribs 12 reinforce the article 1, as well as transverse fiber ribs 13. Random, air-laid fibers 14 fill in the space between the fibers 12 and 13, and are held in place by adhesive 8.

Figure 4:
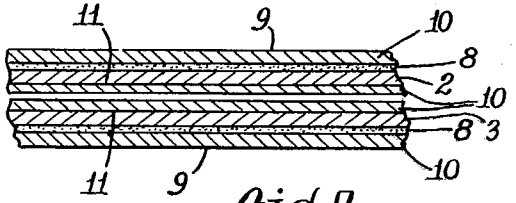
FIG. 4 is an enlarged detail of the circled portion of FIG. 3 to show the original relationship of adhesive and fabric conditioner relative to the outer exposed surface of the folded substrate.
Figure 5:
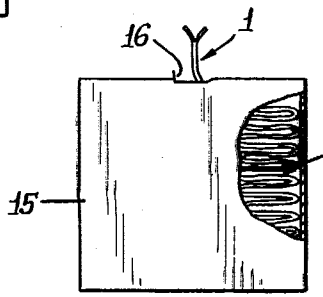
FIG. 5 is a diagrammatic view of a dispenser box, containing a number of the fabric softener articles of FIG. 1, packaged for convenient dispensing.
Figure 1:
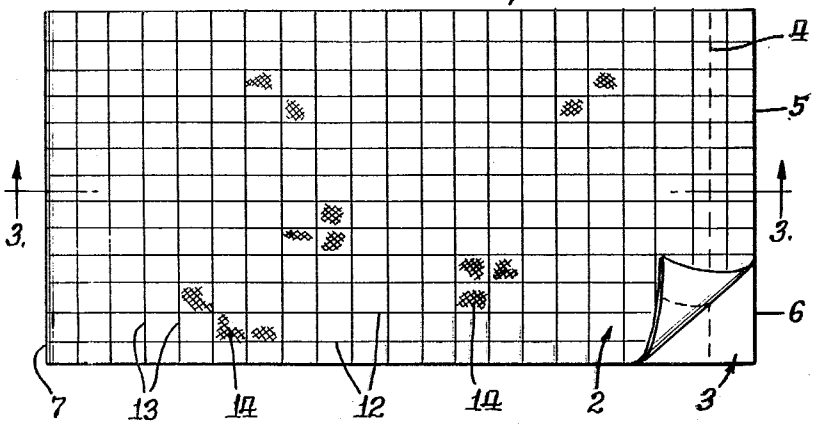
FIG. 1 is a diagrammatic plan view of the folded fabric conditioner article of the invention, as it appears at the time of first use.
Figure 2:
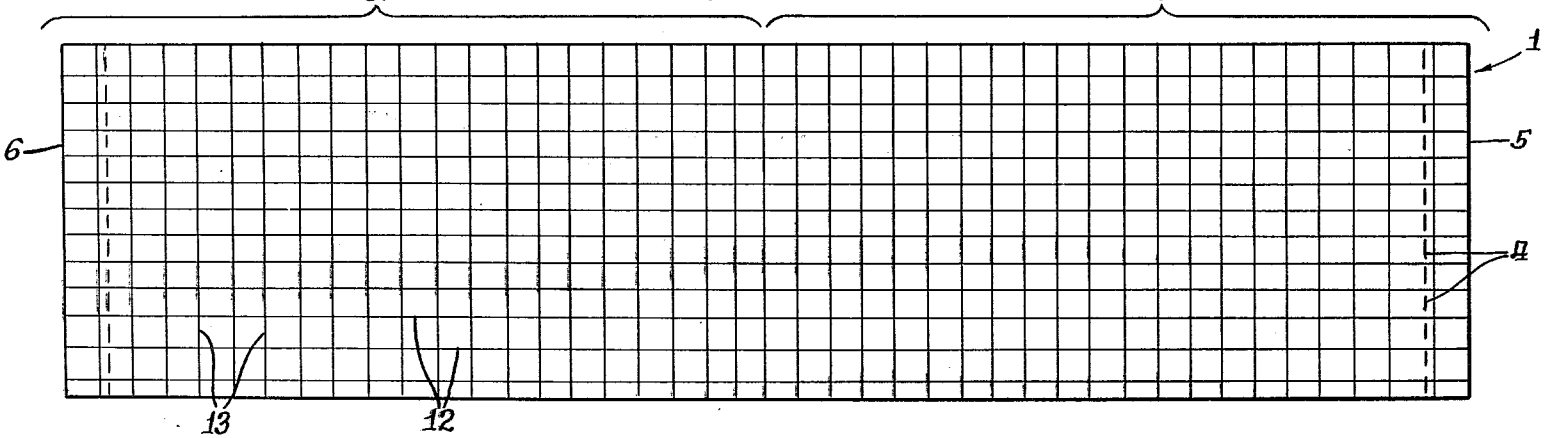
FIG. 2 is a diagrammatic plan view of the fabric conditioner article of FIG. 1 after it has been unfolded, as it appears at the time of second use.

FIG. 4 shows a plurality of fabric softener articles 1 arranged in a dispensing box 15 for convenient dispensing. When a first article 1 is removed from the opening 16 of box 15, the next article 1 is moved into position for dispensing.

SUBSTRATE

The flexible substrate can be any cellulosic or noncellulosic material which is capable of carrying the fabric conditioner material thereon in a manner suitable for ready transfer, both on the initial outer surface of the folded substrate, and also on the inner surface of the folded substrate. The substrate should be capable of releasing sufficient fabric conditioner from the outer surface thereof to soften a first dryer load of clothes, and after opening the fabric conditioner article to its full unfolded length, the substrate should be capable of releasing sufficient conditioner from the previously unexposed surface thereof to effectively condition a second dryer load of clothes.

There are many possible substrate materials, but the one which is presently preferred is manufactured by Kimberly-Clark Corporation, Neenah, WI. It is non-woven, and is an adhesively-bonded, applique-scrim, fabric substrate capable of absorbing a measured amount of fabric conditioner on both surfaces thereof. One surface characteristically carries the adhesive employed to bond the non-woven fibers together. This adhesive-containing surface is preferably the outer surface of the folded fabric conditioner article.

The fabric conditioner is applied to both surfaces of the substrate prior to folding, and the substrate is then folded so that the adhesive-bonded surface faces outwardly. The initially exposed fabric conditioner-coated surface is therefore coated over the adhesive material, and it is presently believed that the adhesive layer prevents fabric conditioner from migrating through the substrate from the inner layer of the folded fabric conditioner article, and transferring to the first dryer load of clothes. Just prior to placing the fabric conditioner article in with a second dryer load of clothes to be softened, the partially exhausted fabric softener article is unfolded to its full length, thereby exposing the unused fabric softener which was initially on the inside surface of the folded fabric conditioner article. This second surface carries enough fabric conditioner to effectively transfer and condition a second dryer load of clothes.

The substrate material can be manufactured by first forming a series of spaced, substantially parallel lengthwise extending threads, and thereafter forming a series of spaced, substantially parallel crosswise extending threads, and then applying adhesive to the web so formed, and finally, an applique of fibers. The crosswise extending threads are also adhesively bonded to the longitudinal threads. The adhesive also serves to bond the fiber applique to the thread-formed web. The adhesive may be applied discontinuously to the longitudinal fibers to give irregularly-spaced breaks along the length of the fiber, and thereby decrease the weight of the substrate without significant decrease in bonding.

The fiber applique may consist of natural or synthetic fibers, or blends thereof, and it may be air-laid or otherwise applied to the web. The fiber weight may vary, but for the subject application, a relatively light-weight fiber is preferred. The desirable substrate weight for present purposes is about 18–22 grams per square yard. The substrate is preferably calendered to flatten the thread junctions and compress the material together to improve its cohesiveness.

The flexibility of the substrate material is preserved to a large degree by applying the adhesive only to the threads extending in one direction, and by providing adhesive-free areas at short intervals. The adhesive employed may be one which is permanently flexible so that the substrate remains flexible. It is also possible to employ an adhesive which stiffens the substrate material, either initially upon curing, or later, in response to the heat in the clothes dryer.

The adhesive may be a solvent, emulsion or hot-melt type, and thermoplastic adhesives in the form of plastisols or organisols may be used. Surface adhesives which do not absorb into the threads are preferred. The presently used adhesive is polyvinyl alcohol. The present substrate adhesive comprises about 50% by weight polyvinyl alcohol or polyvinyl acetate. The amount by weight of adhesive used is based on the total weight of the substrate.

The presently preferred thread and fiber materials comprise a blend of polyester fibers and cotton fibers (which may contain rayon). It is believed that the cotton fibers contribute high-absorbency to the substrate, whereas the polyester fibers contribute strength. Some degree of thermoplasticity in the fibers, as well as in the adhesive, contributes to the overall flexibility of the fabric softener article when subjected to heat in the clothes dryer.

FABRIC CONDITIONER

The fabric conditioner can be any substance which is conveniently transferred to clothes in a clothes dryer to provide the desired "conditioning effect." The most widely used fabric conditioners at the present are fabric "softeners" which give the fabric a softer feel or "hand." Such materials as fragrances, anti-static agents, bactericides, color-brighteners, water-repellents and similar substances may also be included as conditioning materials if capable of transfer from the fabric conditioner article of the invention to fabrics during the tumbling action of the clothes dryer, with or without heat.

For most effective utilization of the folded fabric conditioner article, so that two uses are possible, the fabric conditioner materials should be selected to have melting points and other physical properties which avoid transfer of the conditioners from the inner layer of the folded fabric conditioner article during first use, but when the article is unfolded to its full length, the retained conditioners should be readily transferable to a second dryer load of clothes.

There are many fabric conditioners described in the prior art. Some are nonionic, some are anionic and some are Zwitterionic, but at the present time, those conditioners having the greatest volume of commercial use are cationic quaternary ammonium compounds. Examples of such cationic softeners include dimethyl, distearyl ammonium chloride; N'alkyl* trimethyl ammonium chloride; dialkyl, dimethyl ammonium chloride; methyl difatty alkoxy ammonium sulfate; 2,2' bis(stearyldimethyl ammonium) diethyl ether dichloride.

*Alkyl groups include lauryl, cetyl, stearyl, coco, soya and tallow.

Trade names include:

Arquads (Armour)
Adogens (Ashland)
Culverson (Culver)
Varisoft 222 (Ashland)

The fabric softeners used herein can be selected from the following broadly denoted classes of compounds which contain at least one long-chain group:

1. cationic quaternary ammonium salts and imidazolinium salts;
2. nonionic compounds, such as tertiary phosphine oxides, tertiary amine oxides, ethoxylated alcohols and alkyl phenols and ethoxylated amines;
3. anionic soaps, sulfates and sulfonates, for example fatty acid soaps, ethoxylated alcohol sulfates, sodium alkyl sulfates, alkyl sulfonates, sodium alkylbenzenesulfonates, and sodium or potassium alkyl glyceryl ether sulfonates;
4. amphoteric tertiary ammonium compounds;
5. Zwitterionic quaternary ammonium compounds; and
6. compatible mixtures of one or more compounds of these classes.

The presently preferred fabric softener materials are: ditallow dimethyl ammonium methyl sulfate and sorbitan tristearate, in combination. About 75% by weight ditallow dimethyl ammonium methyl sulfate is used, based on the total dry substance weight of the combination, with 25% by weight (same basis) of sorbitan tristearate.

The combined fabric softeners have a softening point in the range of about 125°–185° F. and more particularly about 130°–155° F. These particular softeners are preferred because they transfer evenly, and do not tend to stain the fabrics being softened.

The softeners may be applied in any of a number of well-known ways, including padding, dipping, roller-applicating, and spraying. For some softener materials, the application is preferably performed at an elevated temperature to facilitate uniform transfer of the softener materials to the substrate.

At the present, the particular fabric softeners used are applied by dipping the substrate in a liquid solution of the softener materials. Other means of application, including padding or spraying, could be used.

A total of 40–80 grams of fabric softener is applied to each square yard of the fabric softener substrate material prior to folding and sealing and packing the articles. This amount of fabric softener will provide adequate softening for the usual dryer load of about 5–7 pounds of clothes and a drying time of about 30–45 minutes.

For mass production manufacture, a continuous web of substrate is fed though suitable drive-rollers to the fabric softener application station where a controlled amount of fabric softener is applied. After the softener has hardened sufficiently, several light applications of adhesive strips are applied transversely to the web at predetermined intervals along its length on the side of the substrate opposite the side which receives the greatest concentration of adhesive during manufacture of the substrates. The sections of substrate are then "accordion-pleated" together so that each section is folded and pressed against the adjacent strip of adhesive. The end-folds adjacent to the adhesive strip are then perforated or otherwise weakened transversely of the web adjacent to the adhesive strip bond, so that one "section," or fabric softener article, can be easily separated from the next adjacent section when they are packed in a dispenser box.

The folded fabric softener article is designed to be unfolded for the second use. After the first use, the dryer operator simply grasps the free "tab" ends adjacent to the inner adhesive strip and pulls the two folded halves apart. This action then exposes the inner surface carrying additional fabric softener. When the unfolded fabric softener article is placed in the clothes dryer on top of a second load of clothes, it tumbles freely with them to transfer an effective amount of fabric conditioner to the clothes during the drying cycle.

The fabric softener article may also be used in the rinse cycle of a clothes washer, if desired. The main advantage in such application is that a premeasured amount of fabric softener is applied.

Since many embodiments of this invention may be made and since many changes may be made in the embodiments described, the foregoing is interpreted as illustrative and the invention is defined by the claims appended hereafter.

We claim:

1. A multiple-use fabric conditioner article for conditioning clothes in a washer or dryer comprising a substrate, a fabric conditioner coated on both surfaces of said substrate, said fabric softener having a softening point in the range of 100° F. to 170° F., and being selected from the group consisting of: cationic quaternary ammonium salts and imidazolinium salts; nonionic compounds, such as tertiary phosphine oxides, tertiary amine oxides, ethoxylated alcohols and alkyl phenols, and ethoxylated amines; anionic soaps, sulfates and sulfonates, including fatty acid soaps, ethoxylated alcohol sulfates, sodium alkyl sulfates, alkyl sulfonates, sodium alkylbenzenesulfonates, and sodium or potassium alkyl glyceryl ether sulfonates; amphoteric tertiary ammonium compounds; Zwitterionic quaternary ammonium compounds; and compatible mixtures of one or more compounds of these classes; said substrate being a water-laid or air-laid non-woven material comprising both natural and synthetic fibers, and having a greater concentration of an adhesive binder at one surface, said fabric conditioner-coated substrate being initially folded and secured loosely by an adhesive seam adjacent to the free ends thereof to expose only the adhesive-bonded surface carrying fabric conditioner, the adhesive seam adjacent the ends being rupturable, whereby the fabric conditioner article can unfold and thereby also expose the second surface of the article to transfer additional fabric conditioner during additional tumbling of said fabric conditioner article with additional clothes to be conditioned.

2. The multiple-use fabric conditioner article of claim 1, in which said substrate is selected from the group of materials consisting of: cellulosic material, non-cellulosic materials; resin-impregnated natural and synthetic fibers, including polyester fibers, cotton fibers, rayon fibers and mixtures thereof.

3. The article of claim 2, in which the adhesive binder comprises about 50% by weight polyvinyl alcohol or polyvinyl acetate.

4. The article of claim 2, in which the adhesive binder is selected from the group consisting of solvent-type adhesive, hot-melt adhesives, an emulsion-type adhesive, and thermoplastic adhesives including plastisols and organisols.

5. The article of claim 1, in which the substrate comprises a blend of polyester fibers and cotton fibers.

6. The article of claim 5, including an adhesive selected from the group consisting of solvent-type adhesives, emulsion-type adhesives, hot-melt adhesives and thermoplastic adhesives including plastisols and organisols.

7. The article of claim 5, in which the ratio of substrate to adhesive is about 1:1 by weight.

8. The article of claim 1, in which the initial dimensions of the folded substrate are about 5½ inches by 9 inches, and the unfolded dimensions are about 5½ inches by about 18 inches.

9. The article of claim 1, including a stiffening substance for causing the article to retain a more stiff condition.

* * * * *